US005802941A

United States Patent [19]

Kline

[11] Patent Number: 5,802,941

[45] Date of Patent: Sep. 8, 1998

[54] ADJUSTABLE CUTTING ROLL ASSEMBLY FOR SEVERING PIECES OF MATERIAL AND METHOD FOR ADJUSTING SAME

[75] Inventor: Keith M. Kline, Massillon, Ohio

[73] Assignee: Akron Steel Fabricators Co., Inc., Akron, Ohio

[21] Appl. No.: 702,976

[22] Filed: Aug. 26, 1996

[51] Int. Cl.[6] ..... B26D 1/12

[52] U.S. Cl. ..... 83/344; 83/346; 83/347

[58] Field of Search ..... 83/331, 343, 344, 83/346, 347, 663, 673

[56] References Cited

U.S. PATENT DOCUMENTS

| | | | |
|---|---|---|---|
| 3,401,585 | 9/1968 | Schmermund | 83/673 |
| 4,205,596 | 6/1980 | Chestnut | 83/344 |
| 4,308,776 | 1/1982 | Gillespie et al. | 83/344 |
| 4,372,327 | 2/1983 | Dyett et al. | 83/344 |
| 4,664,006 | 5/1987 | Mitchell | 83/673 |
| 4,881,436 | 11/1989 | Rommel | 83/343 |

*Primary Examiner*—Maurina T. Rachuba
*Attorney, Agent, or Firm*—Reese Taylor

[57] ABSTRACT

A cutter assembly for severing pieces from a length of material and advanced into proximity thereto includes a driven anvil roll and a driven rotary cutter roll disposed in opposed relation with each whereby the length of material is advanced between the rolls for cutting. The cutter roll carries at least one knife blade on its periphery to cut the material against the anvil roll into predetermined lengths as it is advanced between the rolls. The at least one knife of the cutter roll is mounted at an angle with respect to the longitudinal axis of the cutter roll so as to engage the material in a shearing motion and the cutter roll is attached to the anvil roll and mounted so as to be movable away from the anvil roll against the force of resilient means as the knife contacts the anvil roll during rotation. The degree of such movement may be adjusted by the use of shims removably placed between the resilient means and the mounting point of the cutter roll. A method of establishing the desired spacing includes measuring the distance between the centerlines of the rolls and utilizing shims therebetween to adjust the gap.

5 Claims, 5 Drawing Sheets

ADJUSTABLE CUTTING ROLL ASSEMBLY FOR SEVERING PIECES OF MATERIAL AND METHOD FOR ADJUSTING SAME

FIELD OF THE INVENTION

This invention relates, in general, to a cutting roll assembly for use with a loading conveyor in which lengths of material are advanced along the conveyor to a cutting point and then severed into predetermined lengths for eventual further processing and relates, in particular, to an adjustable cutting roll apparatus in which the cutting roll is adjustable to accommodate different hardnesses and thicknesses of the material to be cut and a method for adjusting the same.

BACKGROUND OF THE INVENTION

It has long been known that rotary cutters can be utilized to sever substantially endless lengths of material into predetermined lengths for feeding into machines for further processing. These cutters generally involve the use of oppositely rotating rolls, one of which carries cutting blades and one of which serves as an anvil against which the material is cut by the blades. One particular environment in which this prior art has been utilized is in the processing of rubber in mills wherein a strip of material is fed along a conveyor after exiting an extruder or being fed from a storage source and then is fed between two opposed rotating rolls, one of which carries cutting blades or knives and which will sever the material against the opposed or anvil roll, permitting discharge of the severed piece to a further processing apparatus such as, for example, a mill.

With the advance in rubber technology, and particularly tire tread technology, the desire to insure longer life for the resulting tire has resulted in the use of a very high composition natural rubber which has a very high Mooney rating and which is very difficult to cut with the conventional arrangement. It is, of course, a definite problem when the knife on the rotating cutter engages the material against the anvil roll and fails to cut it. Obviously the result would be jamming or damage to the equipment in addition to the failure to sever the piece.

In the prior art, it is known that a greater or lesser gap between the cutting blades and the anvil roll can affect the cutting efficiency of the apparatus. Thus, one can ascertain the interference or gap required between the cutter and the anvil rolls to obtain maximum cutting efficiency depending on the thickness and composition of the particular material being cut. In the prior art, adjustments in this gap are commonly made by shaving or machining the cutter blade support body, thereby altering the relative centerlines of the rolls in order to establish that desired gap. It is also possible to grind the outer diameter of the rolls, but the drive gearing of the apparatus is such that the blades do not hit in the same place twice and the blades have a tendency to scrape rather than produce a clean cut. That is, the cutter roll is usually driven slightly faster than the anvil roll so that the leading edge bites into the material. This requires a very fine coordination and there is a risk of losing it if the outer diameters are altered.

In other words, the gap can be preset by controlling the dimensions of the cutter and/or the supporting structure in various ways. However, the difficulty with these approaches is that, at best, they only provide for one fixed gap dimension. Therefore, if a greater or lesser gap is subsequently desired, it is necessary to again shave off material from the cutter body or supporting structure to establish the larger gap and, of course, it is impossible to adjust to a smaller gap without replacing the entire cutter roll apparatus.

It has, therefore, become desirable to provide means for ready and quick adjustment of the gap between the cutter blades and the anvil roll so as to make it readily possible to accommodate different thicknesses and hardnesses of the material to be cut while maintaining a precise cutting action. It is also possible in this way to compensate for wear on the cutter blades to maintain the desired gap without replacing the cutter apparatus.

SUMMARY OF THE INVENTION

It has accordingly been found that the versatility desired in apparatus of this type can be achieved by providing a dial indicator which can be affixed to the mounting structure for the anvil or cutter roll and which is capable of measuring the distance from the centerline of the shaft of the anvil roll to the centerline of the shaft of the cutter roll. It has been found that, in this fashion, the desired distance can be ascertained for presetting the rolls to insure that the interference between the two is precisely determined.

It has also been found that, when different gap dimensions are required, it is possible to insert shims between the blocks on which the pillow block carrying the cutter roll is mounted. This can effectuate an increase or decrease in the gap by adding or subtracting shims and can be readily and quickly done without any alteration or machining of the cutter or anvil rolls or total replacement of the same.

Accordingly, production of an improved adjustable cutting apparatus of the type above described becomes the principal object of this invention with other objects thereof becoming apparent from a reading of the following specification considered and interpreted in view of the accompanying drawings.

BRIEF DESCRIPTION OF THE PREFERRED EMBODIMENTS

Figure 1:
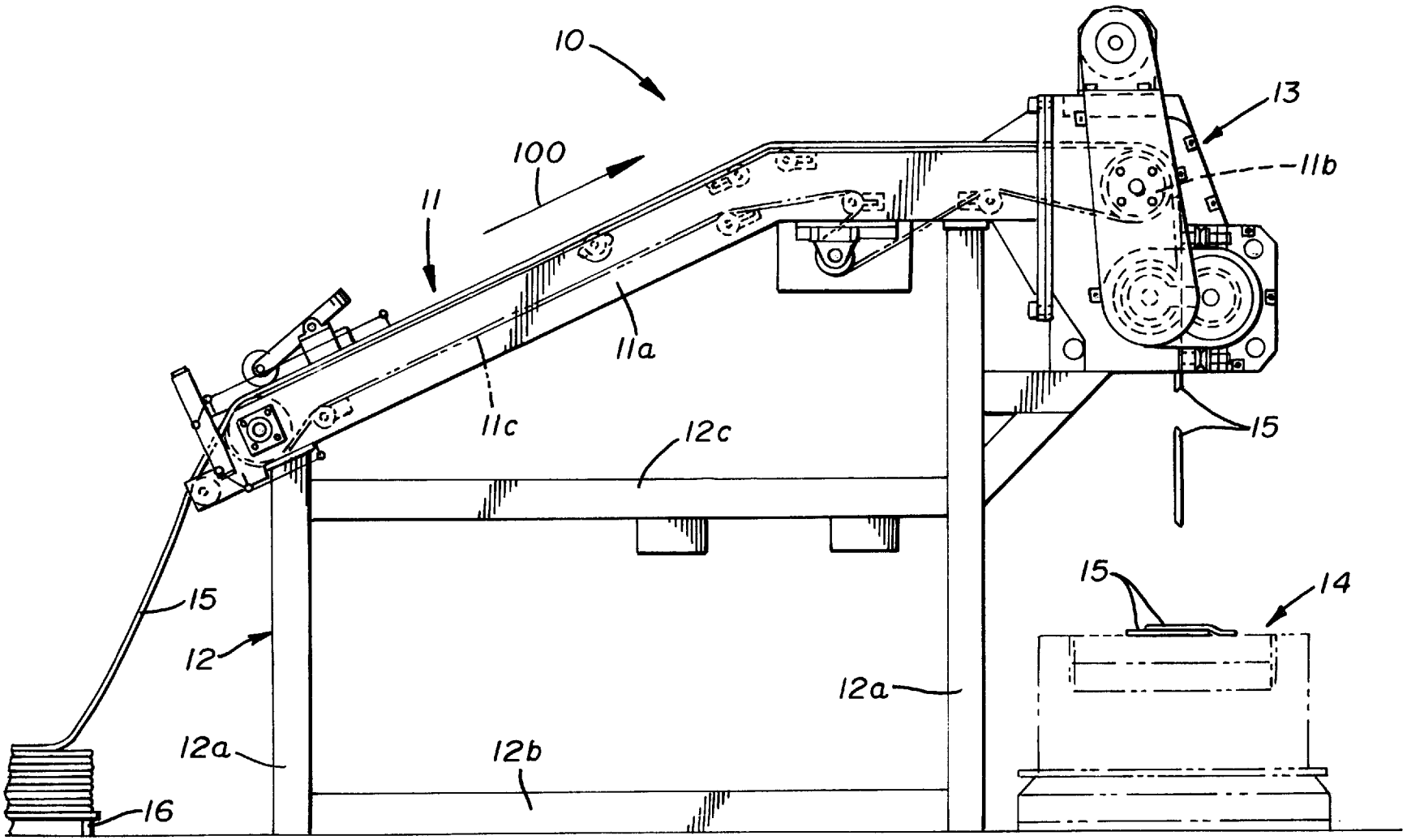
FIG. 1 is a partially schematic elevational view showing a typical environment in which the cutter assembly of the present invention is employed.

Referring first to FIG. 1 of the drawings for a description of the overall environment in which the present invention can be used, it will be seen that the overall apparatus is generally indicated by the numeral 10 and includes a conveyor apparatus 11, a frame 12 supporting the conveyor apparatus and the cutting apparatus, and the cutting apparatus 13 itself. A weigh charge conveyor 14 is shown schematically in the drawings and the material 15 can be seen to be severed and then dropped onto the conveyor for transportation to a machine, such as a mill, as will be described below.

It will be noted that the particular overall conveyor/cutter arrangement illustrated herein is only one typical arrangement and that many other combinations are possible. The salient point is that a continuous length of material is presented to the cutter, by any desired means, and that the material is severed into discrete pieces for further handling or processing.

Still referring to FIG. 1 of the drawings, it will be noted that the frame 12 includes upright members 12*a* and 12*a* and cross members 12*c* and 12*d,* all of which support the conveyor assembly 11 and the cutter assembly 13. The conveyor assembly 11 generally includes an endless belt 11*c* with the usual side guards 11*a* and a motor 11*b* to drive the same around a series of pulleys. No further detail has been provided with regard to the conveyor assembly 11 since it is really a conventional belt conveyor and its particular construction will be well within the knowledge of one of ordinary skill in this art. Suffice it to say that the material is fed onto the conveyor belt 11*c* from the skid at the left of FIG. 1 of the drawings, passes along the belt 11*c* in the direction of arrow 100, and is deposited into the cutter assembly 13 which will now be described.

Figure 2:
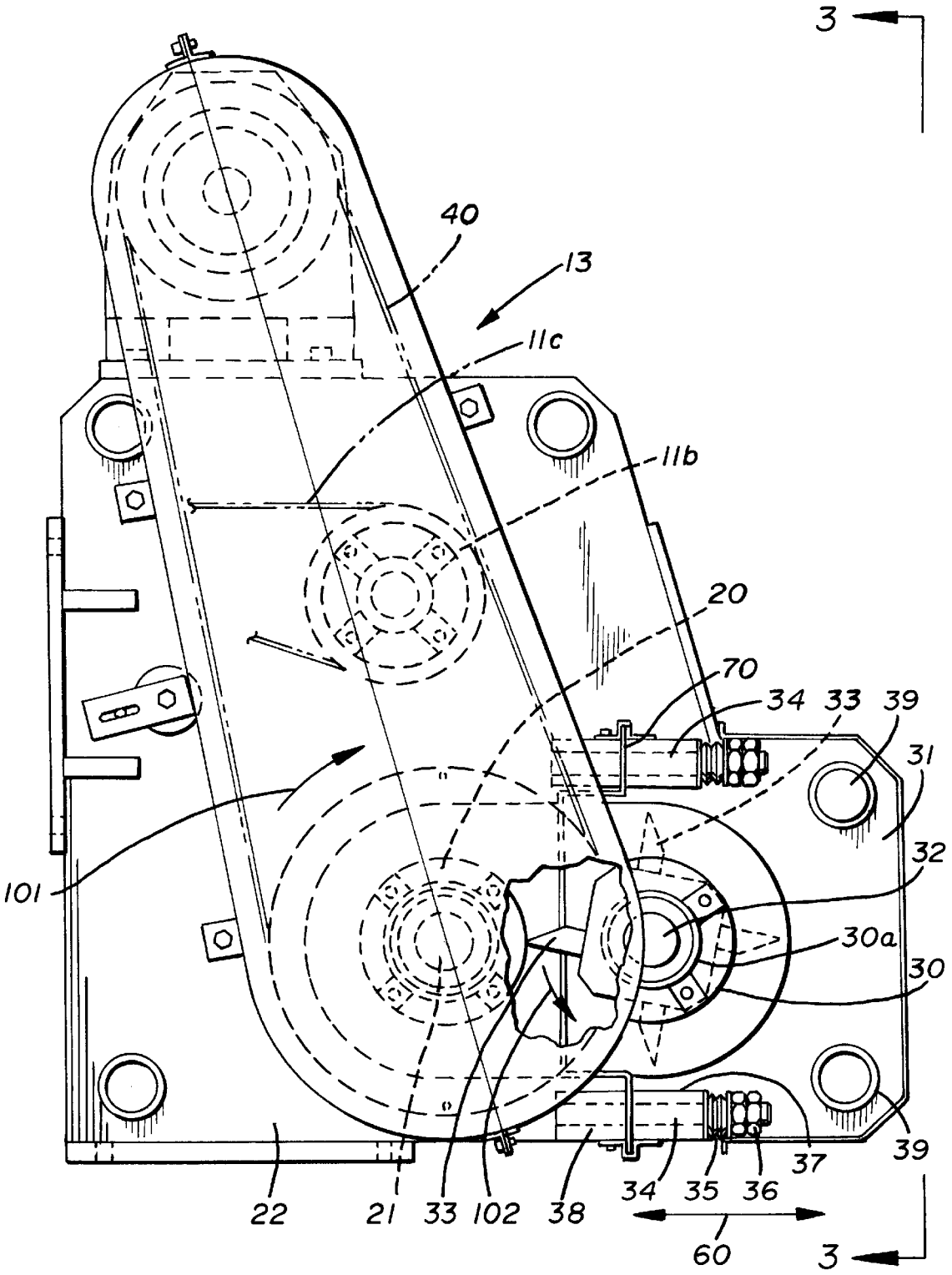
FIG. 2 is an enlarged side elevational view partially broken away showing the anvil roll and the cutter roll in their operation positions.

Referring then to FIG. 2 of the drawings for a description of the cutter assembly 13, it will be noted that this assembly includes an anvil roll 20 and a cutter roll 30. The anvil roll 20 is usually machined from high composition tool steel to form a main body and axially extending journals which are journaled on support 22, and the roll 20 is driven by a belt or chain drive 40 and a gear motor. Thus, the anvil roll 20 is driven to rotate in the direction of arrow 101.

The cutter roll 30 is mounted opposite the anvil roll 20 and usually machined with axially extending journals which are carried on support block 31. This roll 30, which is spaced from anvil roll 20, is also driven to rotate in the direction of arrow 102.

Figure 3:
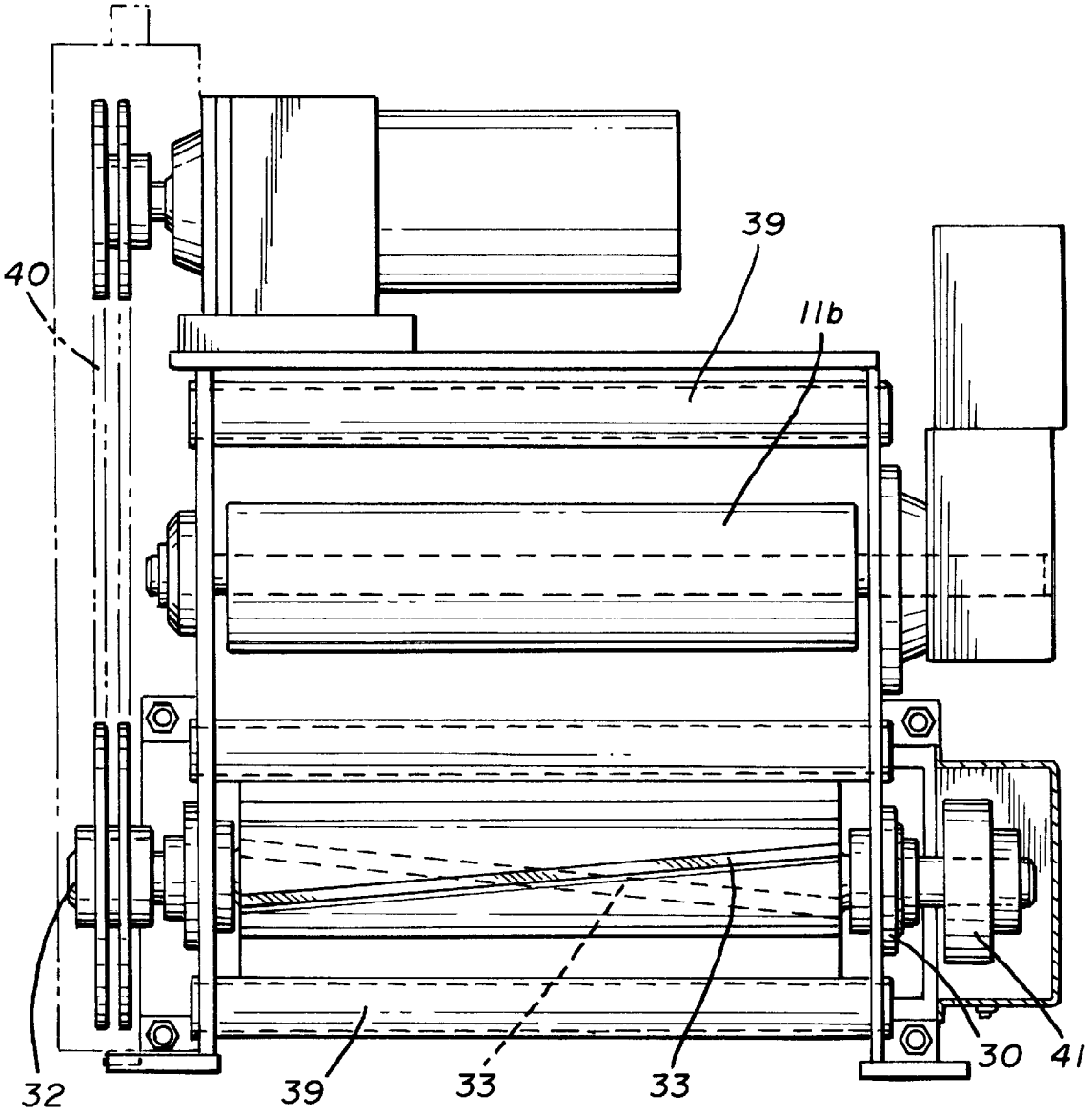
FIG. 3 is a front elevation of the apparatus.

Bolted to cutter roll 30 is a support 31 and a series of knives 33,33 are mounted thereon. Four knives are illustrated herein, although it will be readily appreciated that more or less could be utilized with four, spaced at 90°, improving balance as does any even number of equally spaced knives. As can be seen in FIG. 3 of the drawings, these knives 33 project from the periphery of the cutter roll 30 and are disposed at angles with respect to the plane of longitudinal axis thereof The result of this arrangement is that, as the knives engage the material 15 against the periphery of the anvil roll 20, a shearing action will take place, thereby resulting in more effective cutting. Therefore, a steep angle in the neighborhood of 70 is desirable.

Figure 4:
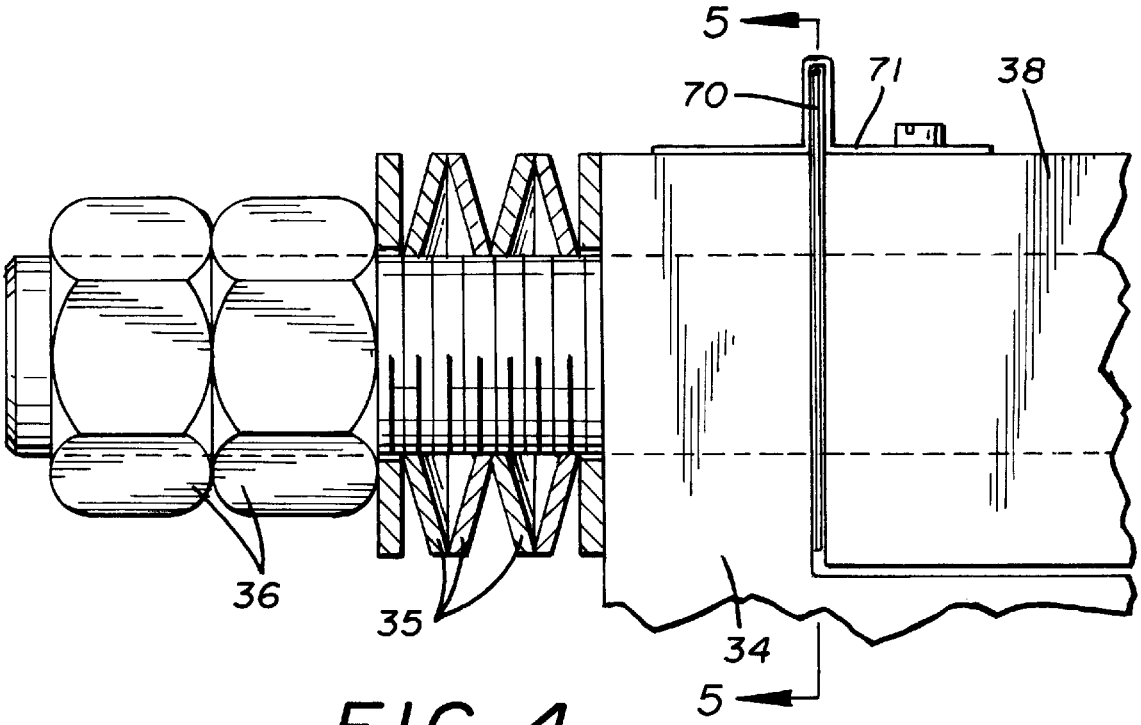
FIG. 4 is an enlarged elevational view showing the shim arrangement of the present invention.
Figure 5:
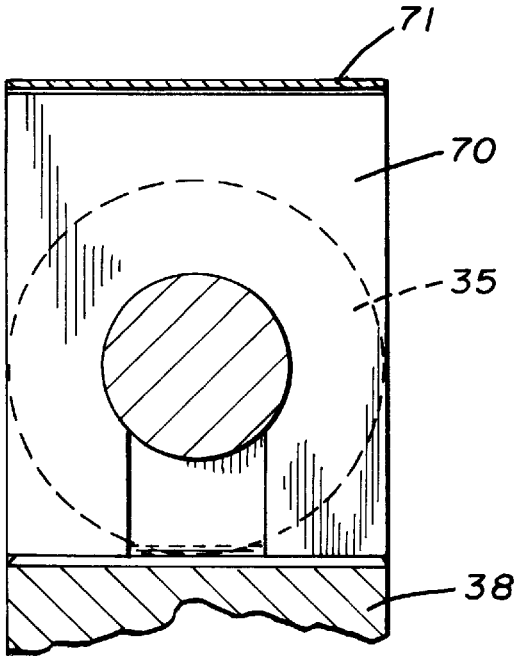
FIG. 5 is a sectional view taken along the line 5—5 of FIG. 4.
Figure 6:
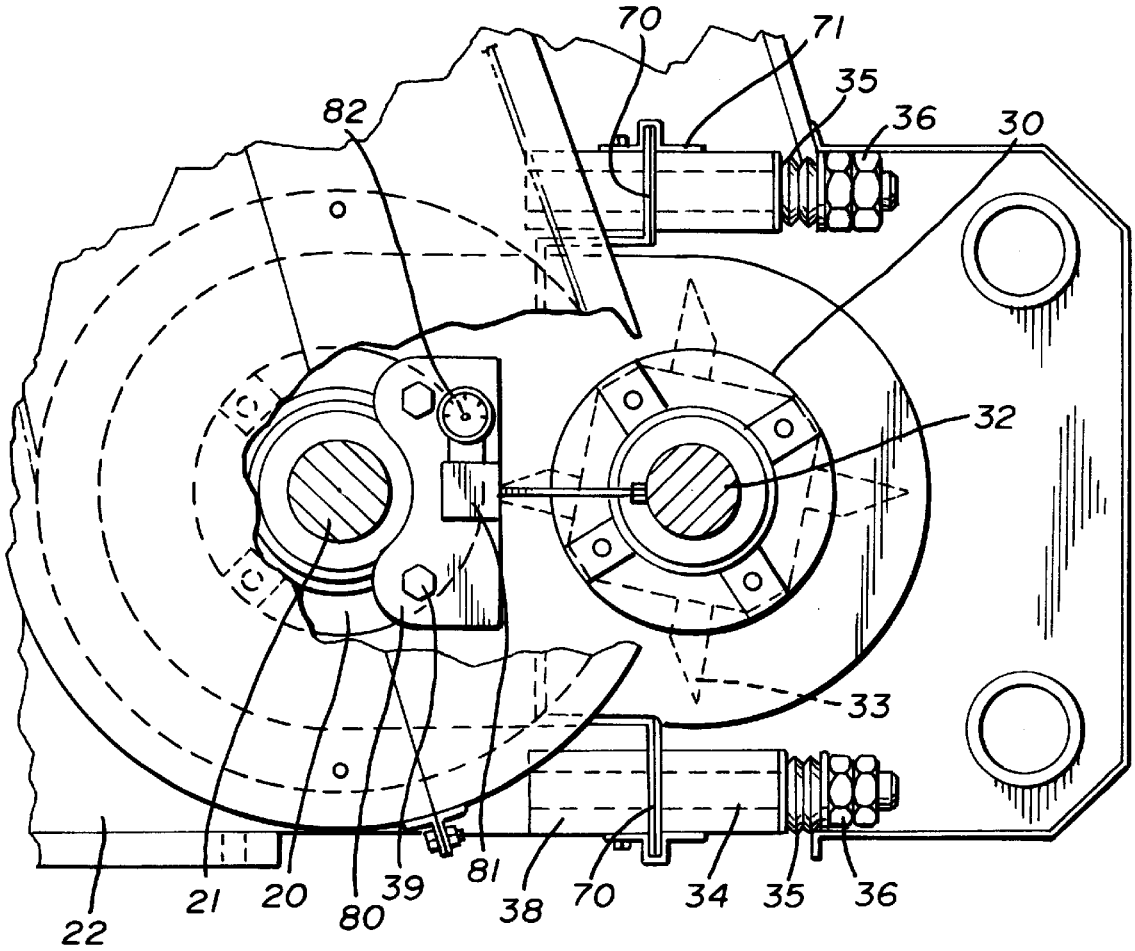
FIG. 6 is a partial elevational view similar to FIG. 2 showing the dial indicator in place.

Still referring to FIG. 2 of the drawings, it will be noted that the support 31 for the cutter roll and support 22 of the anvil roll 20 and support 31 of the cutter 30 have threaded sleeves 37 and 38 welded thereto. Threaded studs 34,34 are received in these sleeves to connect support 31 to support 22. Belleville washers 35 are carried on the ends of studs 34,34 and are held in place by nuts 36, as can be seen in FIGS. 2, 4 and 6. In that regard, the arrangement is that support 22 receives one end of each of the four studs 34 which are disposed at and project from the corners of support 31. Thus, support 31 is secured to block 22 in face-to-face relationship therewith. These studs 34 fit in sleeves 37 and 38, as noted, and the Belleville washers 35 bear against the ends of the sleeves. In this fashion, as the cutter roll 30 rotates in the direction of the arrow 102 and as the projecting edges of the knives 33 encounter the periphery of the anvil drum 20, the support block 31 can move slightly to the right of FIG. 1 against the force of the Belleville springs 35 in the direction of the arrow 60. This floating arrangement prevents damage or destruction of the apparatus as the knives engage the periphery of roll 20 or, more precisely, engage material 15 which lies against the periphery of anvil roll 20.

Figure 7:
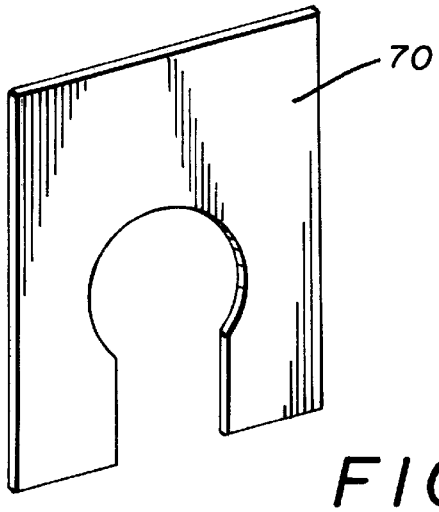
FIG. 7 is a perspective view showing a typical shim.

As noted above, however, the gap between the extended edges of the knives 33 and the periphery of the anvil roll 20 is critical and the desirable spacing varies depending upon the material being severed. To that end, a series of shims 70 (see FIG. 7) are provided between the facing surfaces of sleeves 37 and 38, as can be best seen in FIGS. 2, 4 and 6. As has been noted, the support 31 and the cutter roll 30 will be forced to the right of FIG. 2 of the drawings upon engagement of the knives 33 with the material 15. They will, however, be returned to the starting position once the material has been severed by the action of washers 35. Use of the shims 70 controls the amount of movement of support 31, and thus cutter roll 30 and knives 35, to the right of FIG. 2, thereby controlling the predetermined gap and accommodating varying thicknesses and hardnesses of material. In the event a change is made to a different material requiring a different gap, it is a simple matter to remove or add shims by removing the shim guard or keeper 71 which is simply bolted in place to protect the shims and the operator.

In order to preset the apparatus, and given a known desired gap, a dial indicator of any desired type can be affixed to the support 31 to measure the distance of the centerline of the journal 21 on the anvil roll 20 to the centerline of the journal 32 of the cutter roll. It is possible to adjust this gap then by inserting or removing shims 70 as required.

In effectuating this adjustment, the components such as supports 31 and 22 are first machined so that, when assembled, a fairly large or oversized gap is initially provided. A mounting plate 80 is next attached, by bolts 39,39, to one side of support 31. Following this, a magnetic block 81 carrying dial indicator 82 can be attached to plate 80 and a reading can be taken between the centerlines of journals 21 and 32. Such a reading is taken along each of blades 33. Based on empirical experience with the type of material being cut, sufficient shims 70 can then be inserted to establish the desired gap. Plate 80 can then be transferred to the opposed end of support 31 and the process repeated. Once the plate 80 has been removed, the cutter is ready for operation.

While a full and complete description of the invention has been set forth in accordance with the dictates of the patent statutes, it should be understood that modifications can be resorted to without departing from the spirit hereof or the scope of the appended claims.

Thus, while dial indicator 82 and its mounting plate 80 are shown attached to the anvil roll support, they could also be attached to the cutter roll support.

Also, while four blades 33 are illustrated, more or less could be employed if desired.

What is claimed is:

1. A cutting apparatus for severing material from a length of material moved into proximity with the cutting apparatus on a conveyor, comprising:

(a) a frame disposed adjacent the conveyor;

(b) an anvil roll rotatably mounted on said frame;

(c) a cutter roll rotatably mounted on said frame opposite said anvil roll for movement toward and away from said anvil roll in a direction perpendicular to their centerlines;

(d) at least one knife releasably attached to said cutter roll and projecting radially outwardly from the periphery thereof;

(e) first and second supports mounted on said frame;

(f) said anvil roll being mounted on said first support;

(g) said cutter roll being mounted on said second support with said supports being disposed with their longitudinal axes being disposed in the same horizontal plane;

(h) said second support being connected to said first support by a plurality of elongate connecting members extending therebetween along a line perpendicular to said longitudinal axes;

(i) resilient members disposed on said connecting members and normally urging said second support toward said first support and permitting movement of said second support away from said first support upon interference between said at least one knife with said anvil roll during rotation thereof; and (j) means for adjusting the spacing between the projecting end of said at least one knife and the peripheral surface of said anvil roll.

2. The cutting apparatus of claim 1 wherein a plurality of knives are releasably attached to said cutter roll.

3. The cutting apparatus of claim 1 wherein said at least one said knife comprises an elongate blade; and the longitudinal axis of said blade is disposed at an angle with respect to the longitudinal axis of said cutter roll.

4. The cutting apparatus of claim 3 wherein said angle is about 7°.

5. The cutting apparatus of claim 1 wherein said elongate interconnecting members are elongate headed studs; and said resilient members are springs disposed between said heads and a surface of said second support opposite the surface thereof facing said first support.

* * * * *

UNITED STATES PATENT AND TRADEMARK OFFICE

CERTIFICATE OF CORRECTION

PATENT NO. : 5,802,941

DATED : September 8, 1998

INVENTOR(S) : Keith M. Kline

It is certified that error appears in the above-identified patent and that said Letters Patent is hereby corrected as shown below:

In Column 3, line 46, delete "70" and substitute therefor -- 7° --

Signed and Sealed this

Twenty-second Day of August, 2000

*Attest:*

Q. TODD DICKINSON

*Attesting Officer*

*Director of Patents and Trademarks*